US007315154B2

(12) United States Patent
Sugiura

(10) Patent No.: US 7,315,154 B2
(45) Date of Patent: Jan. 1, 2008

(54) VOLTAGE REGULATOR

(75) Inventor: Masakazu Sugiura, Chiba (JP)

(73) Assignee: Seiko Instruments Inc. (JP)

( * ) Notice: Subject to any disclaimer, the term of this patent is extended or adjusted under 35 U.S.C. 154(b) by 41 days.

(21) Appl. No.: 11/129,801

(22) Filed: May 16, 2005

(65) Prior Publication Data

US 2005/0253569 A1 Nov. 17, 2005

(30) Foreign Application Priority Data

May 17, 2004 (JP) ..... 2004-146076

(51) Int. Cl.
*G05F 1/569* (2006.01)

(52) U.S. Cl. ..... 323/276; 323/281

(58) Field of Classification Search ..... 323/273, 323/274, 277, 280, 281, 282, 284, 351, 276; 327/538, 543; 361/18
See application file for complete search history.

(56) References Cited

U.S. PATENT DOCUMENTS 4,008,418 A * 2/1977 Murphy ..... 361/18
6,100,749 A * 8/2000 Itoh ..... 327/530
6,522,111 B2 * 2/2003 Zadeh et al. ..... 323/277
6,977,491 B1 * 12/2005 Caldwell et al. ..... 323/282
7,015,680 B2 * 3/2006 Moraveji et al. ..... 323/274
7,015,745 B1 * 3/2006 Burinskiy et al. ..... 327/543

* cited by examiner

*Primary Examiner*—Adolf Berhane
(74) *Attorney, Agent, or Firm*—Adams & Wilks

(57) ABSTRACT

A voltage regulator has an output MOS transistor connected between a voltage source and an output terminal. A voltage dividing circuit is disposed between the output terminal and GND. An error amplifier receives a reference voltage from a reference voltage circuit and a division voltage from the voltage dividing circuit. A current limiting circuit is disposed between the voltage source and the output terminal. The current limiting circuit has a first MOS transistor connected to the voltage source. A current source circuit is disposed between the first MOS transistor and the output terminal. A resistor is connected to the voltage source. A second MOS transistor is controlled based on a current caused to flow through the first MOS transistor. A third MOS transistor is connected between the voltage source and an output terminal of the error amplifier and is controlled based on a current caused to flow through the resistor. When a current caused to flow through the first MOS transistor reaches a predetermined current, the current limiting circuit controls the output MOS transistor to limit a current outputted through the output terminal.

3 Claims, 3 Drawing Sheets

VOLTAGE REGULATOR

BACKGROUND OF THE INVENTION

1. Field of the Invention

The present invention relates to a voltage regulator which is capable of suppressing dispersion in an output short circuit current of the voltage regulator.

2. Description of the Related Art

FIG. 3 shows a circuit diagram of a conventional voltage regulator. The conventional voltage regulator includes: a voltage regulator control circuit having a reference voltage circuit 10, bleeder resistors 11 and 12 through which an output voltage Vout at an output terminal 6 is divided, and an error amplifier 13 for amplifying a difference between a reference voltage Vref1 and the division voltage; and an output P-channel MOS transistor 14. The conventional voltage regulator is operated with a voltage VDD1 supplied from a voltage source 15.

When an output voltage from the error amplifier 13 is assigned Verr, and a voltage at a node between the bleeder resistors 11 and 12 is assigned Va, if Vref1>Va, the output voltage Verr decreases, while if Vref1<Va, the output voltage Verr increases. That is, the voltage regulator control circuit operates to decrease an ON-resistance of the output P-channel MOS transistor 14 to increase the output voltage Vout when the output voltage becomes lower. Conversely, the voltage regulator control circuit operates to increase the ON-resistance of the output P-channel MOS transistor 14 to decrease the output voltage Vout when the output voltage Verr becomes high. Thus, the voltage regulator control circuit operates to hold the output voltage Vout at a constant value.

In general, in the case of the voltage regulator, since an output current is supplied from the output P-channel MOS transistor 14, when a load is lightened, a loss of the output P-channel MOS transistor 14 becomes extremely large. Thus, a voltage regulator as shown in FIG. 4 is designed in which a case where a load is short-circuited is taken into consideration.

The voltage regulator shown in FIG. 4 includes a current limiting circuit at its output terminal. A P-channel MOS transistor 21 is provided for the purpose of monitoring a drain current of the output P-channel MOS transistor 14, i.e., an output current. A W/L value (with W denoting width and L denoting length) of the P-channel MOS transistor 21 is set to be much smaller (e.g., 1/100) than that of the output P-channel MOS transistor 14. The output P-channel MOS transistor 14 and the P-channel MOS transistor 21 show a current mirror relation. Hence, when a load resistance decreases and thus the output current increases, a drain current of the P-channel MOS transistor 21 increases accordingly. As a result, an electric potential difference developed across mutually opposite terminals of a resistor 22 also increases. When the electric potential difference developed across the mutually opposite terminals of the resistor 22 reaches a threshold voltage of an N-channel MOS transistor 23, the N-channel MOS transistor 23 is turned ON. Thus, an invert circuit including the N-channel MOS transistor 23 and a resistor 24 turns ON a P-channel MOS transistor 25. As a result, since the control is carried out so that a gate to source voltage of the output P-channel MOS transistor 14 decreases, an output current is limited based on a negative feedback operation.

Moreover, the output current is limited at an operating point at which the electric potential difference developed across the mutually opposite terminals of the resistor 22 is considered equal to the threshold voltage of the N-channel MOS transistor 23. Here, a backgate bias voltage is applied to the N-channel MOS transistor 23. Hence, since the threshold voltage of the N-channel MOS transistor 23 decreases as the output voltage decreases, the value of the output current is limited to a low value. It is known that a relationship between the output current and the output voltage shows a foldback characteristics as shown in FIG. 5 (see JP Hei 4-195613 A (Page 3, FIG. 1)).

However, in the conventional voltage regulator as shown in FIG. 4, when the load is lightened, the output current is limited at the operating point at which the electric potential difference developed across the mutually opposite terminals of the resistor 22 is given as being equal to the threshold voltage of the N-channel MOS transistor 23. Hence, there arises a problem in that dispersion is generated in an output short circuit current due to an influence of the manufacturing dispersion in the threshold voltage of the N-channel MOS transistor 23 and the resistance value of the resistor 22, and thus it is difficult to control the output short circuit current to a set value. A loss of the output P-channel MOS transistor 14 causes the calorification. In this case, the loss of the output P-channel MOS transistor 14 is not permitted to exceed an allowable level. Consequently, it is desirable that the output short circuit current has a small value free from the dispersion.

SUMMARY OF THE INVENTION

In light of the foregoing, the present invention has been made in order to solve such a problem inherent in the related art, and it is, therefore, an object of the present invention to control an output short circuit current of a voltage regulator in order to suppress dispersion in the output short circuit current.

In order to attain the above-mentioned object, according to the present invention, there is provided a voltage regulator including a current limiting circuit, in which a current source circuit is used instead of an output short circuit current detecting resistor of the current limiting circuit.

More specifically, the present invention provides a voltage regulator including: an output MOS transistor connected between a voltage source and an output terminal; a voltage dividing circuit provided between an output terminal and a GND; an error amplifier for receiving as its input a reference voltage from a reference voltage circuit and a division voltage from the voltage dividing circuit; and a current limiting circuit provided between the voltage source and the output terminal, in which the current limiting circuit includes a first MOS transistor connected to the voltage source and controlled based on an output signal from the error amplifier, and a current source circuit provided between the first MOS transistor and the output terminal, and when detecting a current caused to flow through the first MOS transistor reaches a predetermined current, the current limiting circuit controls the output MOS transistor to limit a current outputted through the output terminal.

In the voltage regulator of the present invention, the current limiting circuit includes: a first N-channel MOS transistor provided between the first MOS transistor and the output terminal; a second N-channel MOS transistor connecting the first N-channel MOS transistor and a current mirror; and a constant current circuit for setting a current caused to flow through the second N-channel MOS transistor, and a backgate bias voltage is applied to the second N-channel MOS transistor.

According to the voltage regulator of the present invention, the current limiting circuit for controlling the output short circuit current to a set value is provided, whereby there is offered an effect that the dispersion in the output short circuit current due to the manufacturing dispersion can be eliminated. Moreover, the output short circuit current controlled by the current limiting circuit can be set to a desired value.

BRIEF DESCRIPTION OF THE DRAWINGS

In the accompanying drawings.

DETAILED DESCRIPTION OF THE PREFERRED EMBODIMENTS

Figure 1:
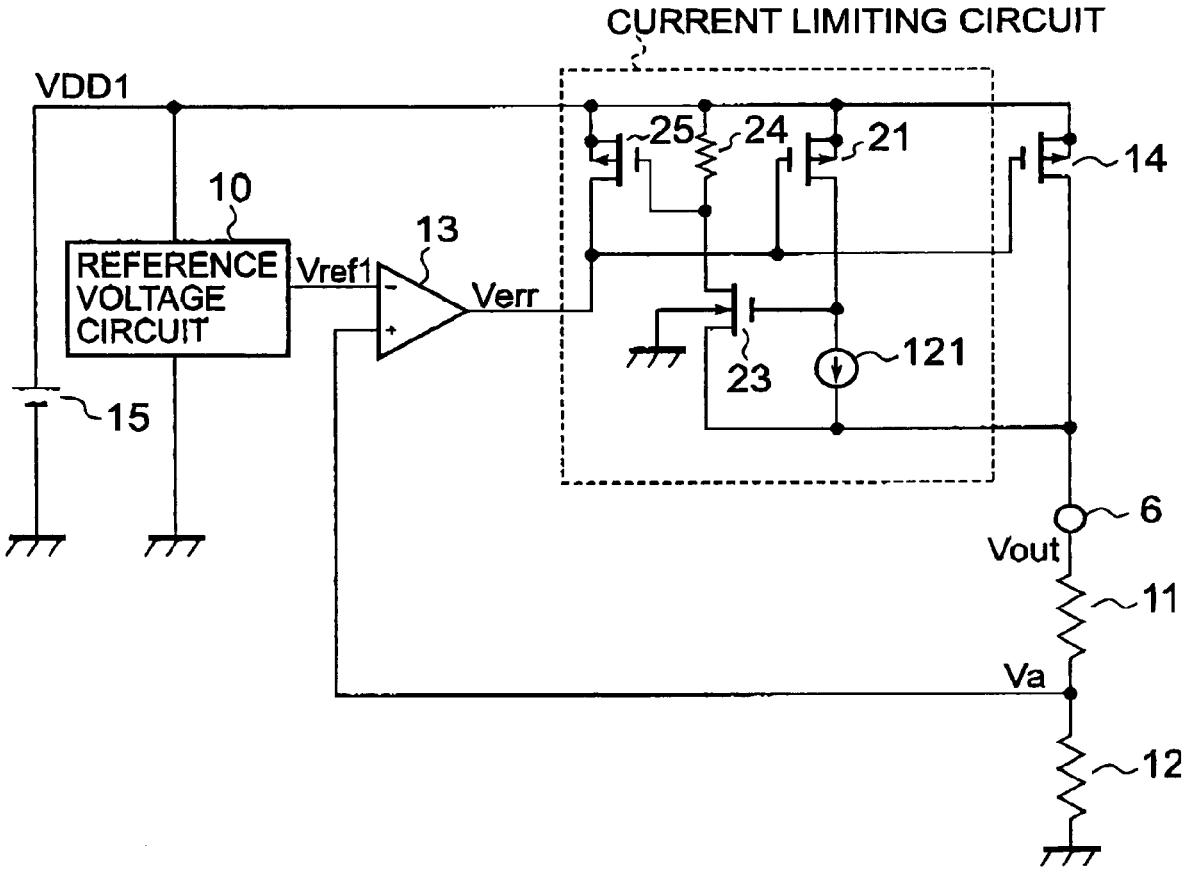
FIG. 1 is a circuit diagram showing a configuration of a voltage regulator according to an embodiment of the present invention.

FIG. 1 is a circuit diagram showing a configuration of a voltage regulator according to an embodiment of the present invention. The voltage regulator according to this embodiment of the present invention is provided with a current limiting circuit including a P-channel MOS transistor 21 connected with an output P-channel MOS transistor 14 to make a current mirror circuit, a current source circuit 121 connected between the P-channel MOS transistor 21 and an output terminal 6, and a P-channel MOS transistor 25 connected between a power supply 15 for supplying a power supply voltage VDD1 and an output terminal of an error amplifier 13.

Figure 4:
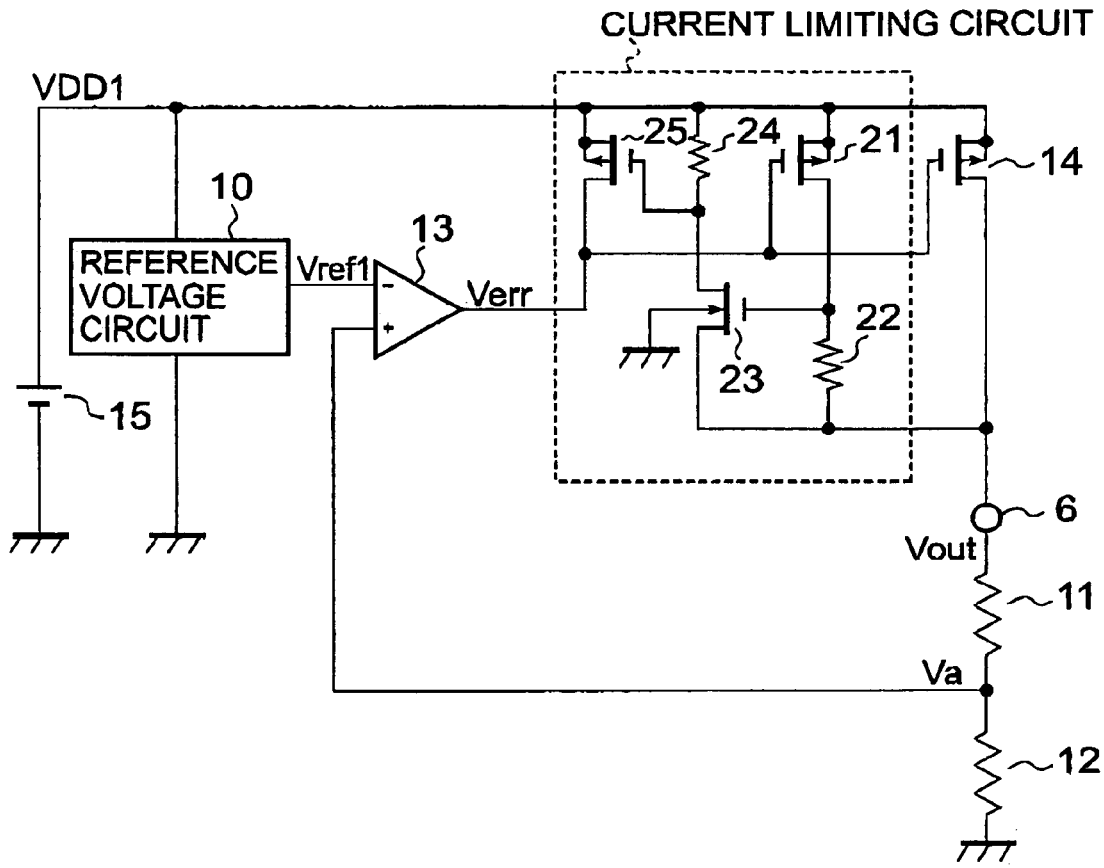
FIG. 4 PRIOR ART
FIG. 4 is a circuit diagram showing a configuration of another example of the conventional voltage regulator.

That is, the feature of the voltage regulator according to this embodiment of the present invention resides in that the current source circuit 121 is used instead of the resistor 22 of the current limiting circuit of the conventional voltage regulator (refer to FIG. 4). A current value of the current source circuit 121 is designed so as to decrease as an output voltage decreases, and when the output voltage becomes 0 V, the current value of the current source circuit 121 can be given as a set value. In addition, even though the current source circuit 121 requires a positive power supply and a negative power supply or GND, illustration thereof is omitted in FIG. 1.

Figure 2:
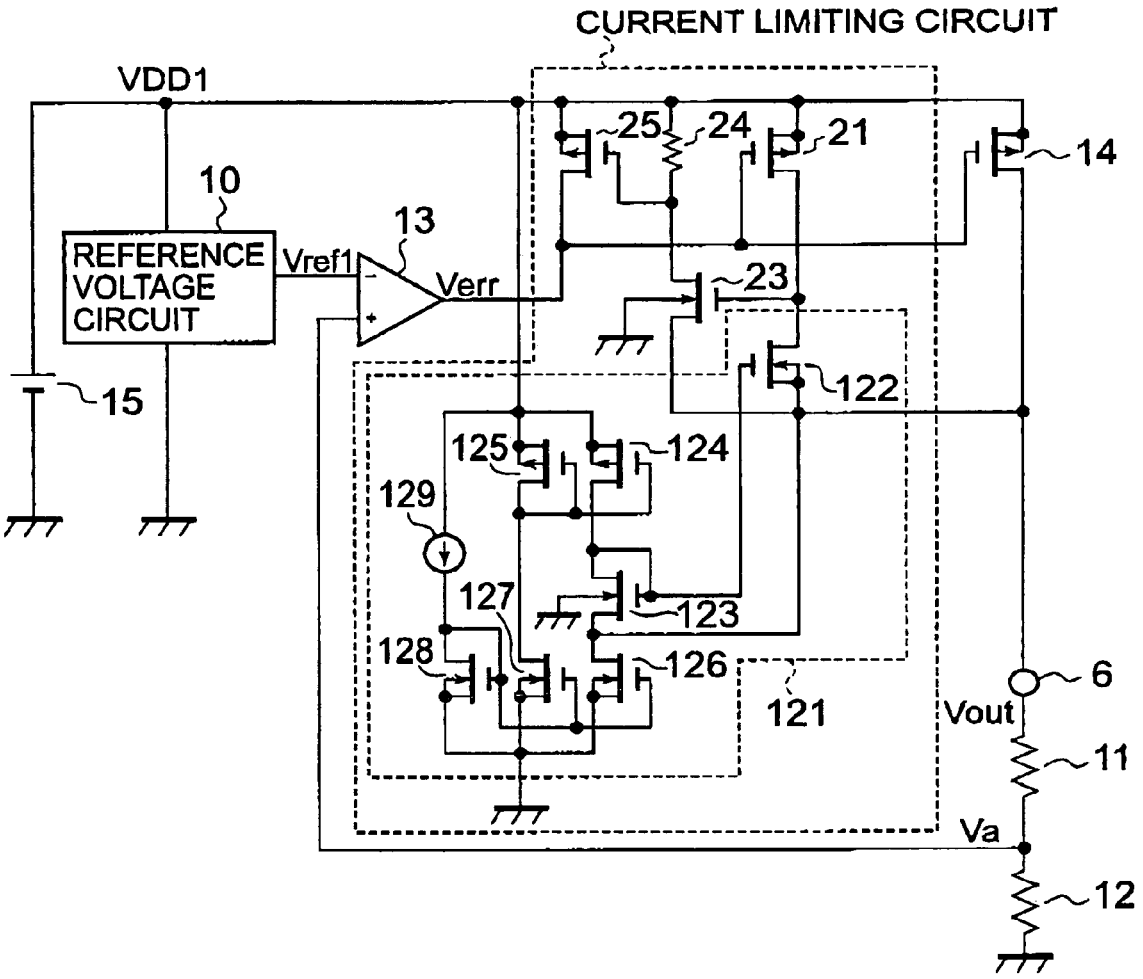
FIG. 2 is a circuit diagram showing a configuration of an example of a current source circuit of the voltage regulator according to the embodiment of the present invention.
Figure 3:
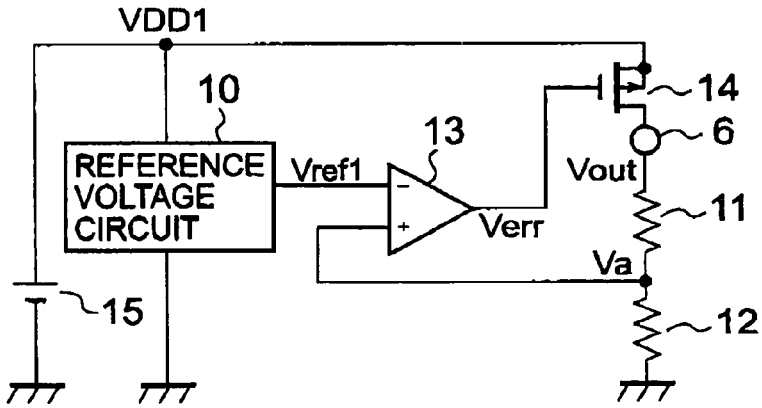
FIG. 3 PRIOR ART
FIG. 3 is a circuit diagram showing a configuration of an example of a conventional voltage regulator.

FIG. 2 is a detailed circuit diagram showing a configuration of the current source circuit 121 of the voltage regulator according to this embodiment of the present invention. The current source circuit 121 includes: a constant current circuit 129; an N-channel MOS transistor 122 and an N-channel MOS transistor 123 which are equal in W/L value to each other and which show a current mirror relation: an N-channel MOS transistor 126, an N-channel MOS transistor 127, and an N-channel MOS transistor 128 which are equal in W/L value to each other and which show a current mirror relation; and a P-channel MOS transistor 124 and a P-channel MOS transistor 125 which are equal in W/L value to each other and which show a current mirror relation.

Now, let us consider a case where a load resistance is large, and thus a drain current which the P-channel NOS transistor 21 intends to cause to flow is less than that which the N-channel MOS transistor 122 intends to cause to flow. At this time, since the N-channel MOS transistor 23 is not turned ON, the current limiting circuit does not operate. That is, the output current is not limited by the current limiting circuit. When a current value of the constant current circuit 129 is I1, the drain current value of the N-channel MOS transistor 123 becomes I1, because the N-channel MOS transistor 126, the N-channel MOS transistor 127, and the N-channel MOS transistor 128 are equal in W/L value to each other and are in the current mirror relation, and because the P-channel MOS transistor 124 and the P-channel MOS transistor 125 are equal in W/L value to each other and are in the current mirror relation. While the N-channel MOS transistor 122 and the N-channel MOS transistor 123 are equal in W/L value to each other and show the current mirror relation, since a backgate bias voltage is applied to the N-channel MOS transistor 123, the threshold voltage of the N-channel MOS transistor 123 becomes larger than that of the N-channel MOS transistor 122. Therefore, the value of the drain current which the N-channel MOS transistor 122 intends to cause to flow becomes larger than the current value I1.

Figure 5:
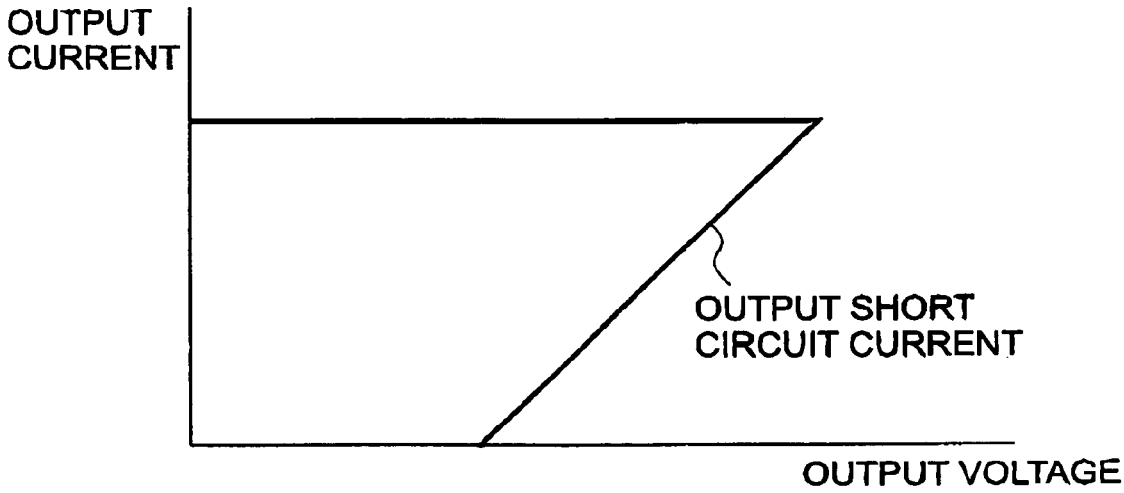
FIG. 5 PRIOR ART
FIG. 5 is a graphical representation explaining characteristics showing a relationship between an output voltage and an output current in the conventional voltage regulator.

Next, let us consider a case where the load resistance is small, and thus the value of the drain current which the P-channel MOS transistor 21 intends to cause to flow becomes equal to that of the drain current which the N-channel MOS transistor 122 intends to cause to flow. In this case, since the N-channel MOS transistor 23 is turned ON, the current limiting circuit operates in accordance with the same operation principles as those in the related art. That is, the output current is limited at an operating point at which the value of the drain current which the P-channel MOS transistor 21 intends to cause to flow is given as being equal to that of the drain current which the N-channel MOS transistor 122 intends to cause to flow. Here, the backgate bias voltage is applied to the N-channel MOS transistor 123. Thus, since the threshold voltage of the N-channel MOS transistor 123 decreases as the output voltage decreases, the value of the drain current which the N-channel MOS transistor 122 intends to cause to flow decreases. Accordingly, the value of the output current is limited to the lower value, and thus the output current shows the foldback characteristics (see FIG. 5).

Moreover, when the output voltage becomes 0 V, the N-channel MOS transistor 122 and the N-channel MOS transistor 123 have the same conditions related to the backgate bias voltage. Hence, the value of the drain current which the N-channel MOS transistor 122 intends to cause to flow becomes equal to I1, which is the value of the drain current of the N-channel MOS transistor 123. This drain current value cannot be but the current value I1 of the constant current circuit 129.

The output current is limited at the operating point at which the value of the drain current which the p-channel MOS transistor 21 intends to cause to flow is given as being equal to that of the drain current which the N-channel MOS transistor 122 intends to cause to flow. Thus, when the output voltage becomes 0 V, the value of the drain current which the N-channel MOS transistor 122 intends to cause to flow is determined by the current value I1 of the constant current circuit 129. Hence, the current value I1 of the constant current circuit 129 constituted by a transistor and a resistor for example is set to a suitable value using means such as resistance trimming, whereby the output short circuit current can be controlled to a set value. As a result, the difficulty in controlling the output short circuit current to the set value may be solved, since the dispersion is generated in the output short circuit current due to an influence of the manufacturing dispersion in the threshold voltage of the N-channel MOS transistor 23 and the resistance value of the resistor 22 in the conventional voltage regulator (see FIG. 4).

Note that since the drain to source voltage of the N-channel MOS transistor 126 is 0 V at this time, the drain current value of the N-channel MOS transistor 126 becomes 0. Accordingly, the drain current of the N-channel MOS transistor 123 is caused to flow out as an output current to the outside unit through the output terminal 6 of the voltage regulator.

While the foregoing description relates to the case where the current value I1 of the constant current circuit 129 is set to a suitable value, it is obvious that the set value of the output short circuit current controlled by the current limiting circuit may be made variable by changing the current value I1 and thus can be arbitrarily set.

In addition, while the configuration of the current source circuit 121 has been described as shown in FIG. 2, it is evident that the same effects as those in the case of the current source circuit 121 having the same configuration can be obtained even when the current source circuit 121 possesses a different configuration as long as the current source circuit 121 having this configuration possesses the same function as that of the current source circuit 121 having the same configuration.

What is claimed is:

1. A voltage regulator comprising:

an output MOS transistor connected between a voltage source and an output terminal;

a voltage dividing circuit disposed between the output terminal and GND;

a reference voltage circuit;

an error amplifier that receives a reference voltage from the reference voltage circuit and a division voltage from the voltage dividing circuit; and a current limiting circuit disposed between the voltage source and the output terminal, the current limiting circuit comprising a first MOS transistor connected to the voltage source and controlled based on an output signal from the error amplifier, a current source circuit disposed between the first MOS transistor and the output terminal, a resistor connected to the voltage source, a second MOS transistor controlled based on a voltage that causes a current to flow through the first MOS transistor, and a third MOS transistor connected between the voltage source and an output terminal of the error amplifier and controlled based on a voltage that causes a current to flow through the resistor;

wherein when a current caused to flow through the first MOS transistor reaches a predetermined current, the current limiting circuit controls the output MOS transistor to limit a current outputted through the output terminal, and wherein the current source circuit comprises:

a constant current circuit connected to the voltage source;

a first N-channel MOS transistor connected to the constant current circuit;

a second N-channel MOS transistor and a third N-channel MOS transistor disposed in current mirror relation to the first N-channel MOS transistor;

a first P-channel MOS transistor connected between the voltage source and the second N-channel MOS transistor;

a second P-channel MOS transistor disposed in current mirror relation to the first P-channel MOS transistor;

a fourth N-channel MOS transistor connected between the second P-channel MOS transistor and the third N-channel MOS transistor; and a fifth N-channel MOS transistor connected between the output terminal and the first MOS transistor and disposed in current mirror relation to the fourth N-channel MOS transistor.

2. A voltage regulator according to claim 1; wherein the fifth N-channel MOS transistor and the fourth N-channel MOS transistor have the same W/L value, where W denotes the width and L denotes the length of the transistor; wherein the third N-channel MOS transistor, the second N-channel MOS transistor, and the first N-channel MOS transistor have the same W/L value; and wherein the second P-channel MOS transistor and the first P-channel MOS transistor have the same W/L value.

3. A voltage regulator according to claim 1; wherein a threshold voltage of the fourth N-channel MOS transistor is larger than a threshold voltage of the fifth N-channel MOS transistor when a backgate bias voltage is applied to the fourth N-channel MOS transistor.

* * * * *